US010323437B2

(12) United States Patent
Hallett

(10) Patent No.: US 10,323,437 B2
(45) Date of Patent: Jun. 18, 2019

(54) ACCESS CONTROL DEVICE

(71) Applicant: PAXTON ACCESS LIMITED, Brighton (GB)

(72) Inventor: Aaron Hallett, Brighton (GB)

(73) Assignee: PAXTON ACCESS LIMITED, Brighton (GB)

( * ) Notice: Subject to any disclaimer, the term of this patent is extended or adjusted under 35 U.S.C. 154(b) by 128 days.

(21) Appl. No.: 15/332,753

(22) Filed: Oct. 24, 2016

(65) Prior Publication Data

US 2017/0114570 A1 Apr. 27, 2017

(30) Foreign Application Priority Data

Oct. 27, 2015 (GB) ..... 1518967.3

(51) Int. Cl.
*E05B 47/00* (2006.01)
*E05B 63/08* (2006.01)
(Continued)

(52) U.S. Cl.
CPC ..... *E05B 63/08* (2013.01); *E05B 9/08* (2013.01); *E05B 15/02* (2013.01); *E05B 47/00* (2013.01);
(Continued)

(58) Field of Classification Search
CPC . E05B 63/08; E05B 9/08; E05B 47/00; E05B 49/00; G07C 9/00142; G07C 9/00158
(Continued)

(56) References Cited

U.S. PATENT DOCUMENTS 3,107,113 A 10/1963 Sconzo
2008/0132100 A1 6/2008 Craig
(Continued)

FOREIGN PATENT DOCUMENTS

CN 2639449 9/2004
DE 19834692 3/2000
(Continued)

OTHER PUBLICATIONS

EP16196127.1 Search Report dated Feb. 21, 2017.
GB1518966.5 Search Report dated Apr. 27, 2016.
GB1518967.3 Search Report dated Apr. 27, 2016.

*Primary Examiner* — Suzanne L Barrett
(74) *Attorney, Agent, or Firm* — Jeffer Mangels; Butler & Mitchell LLP; Brennan C. Swain, Esq.

(57) ABSTRACT

An access control device 3 comprising: a locking mechanism 1 for a moveable barrier 2; a first locking/user interface component 6 for positioning on a first side of the moveable barrier; and a second locking/user interface component 7 for positioning on a second side of the moveable barrier. The first and second components are arranged to be secured to an intermediary barrier member 4, provided with either a first set of through holes for a first alternative locking member or a second set of through holes for a second alternative locking member, the first set of through holes including a hole having a mutually distinct position from a hole included in the second set of through holes. The first and second components are provided with fixing apertures 19 21 corresponding to the first and second sets of through holes so that the components can be secured via a fixing 17 18 placed in a hole corresponding to either of the alternative locking members, without requiring additional through holes in the moveable barrier. A method of fitting an access control device is also provided.

14 Claims, 8 Drawing Sheets

(51) Int. Cl.

| | |
|---|---|
| ***E05B 63/00*** | (2006.01) |
| ***E05B 9/08*** | (2006.01) |
| ***E05B 15/02*** | (2006.01) |
| ***E05B 49/00*** | (2006.01) |
| ***G07C 9/00*** | (2006.01) |

(52) U.S. Cl.
CPC ..... *E05B 49/00* (2013.01); *E05B 63/0056* (2013.01); *G07C 9/00142* (2013.01); *G07C 9/00158* (2013.01); *E05B 63/0052* (2013.01); *E05B 2047/0091* (2013.01); *E05B 2047/0094* (2013.01)

(58) Field of Classification Search
USPC ..... 70/277, 279.1, 451, 452, 466
See application file for complete search history.

(56) References Cited

U.S. PATENT DOCUMENTS

| | | | | |
|---|---|---|---|---|
| 2009/0193859 | A1* | 8/2009 | Kwon | E05B 47/026 70/91 |
| 2012/0218076 | A1* | 8/2012 | Zacchio | E05B 47/02 340/5.61 |
| 2017/0116801 | A1* | 4/2017 | Hallett | E05B 47/00 |

FOREIGN PATENT DOCUMENTS

| | | |
|---|---|---|
| DE | 10045492 | 4/2002 |
| DE | 102004057114 | 8/2006 |
| EP | 2924205 | 3/2015 |
| GB | 2460222 | 11/2009 |
| WO | 2008003977 | 1/2008 |
| WO | 2010001170 | 1/2010 |

* cited by examiner

ACCESS CONTROL DEVICE

The present invention generally relates to access control devices and a corresponding method of fixing an access control device, particularly for use in doors.

Electro-mechanical and electronic access control devices, commonly referred to as locks, need to pass electrical power and or signal data between electrical components to operate and to allow the decoding of inputs caused by persons attempting access and also to provide motive force for initiating unlocking.

Such locks are often used in doors, including fire doors. Fire doors have to meet certain regulations; for instance, in the UK they must be subjected to a British Standard Fire Test. Regulations may not be met, or the fire rating of a door may be reduced, if for instance a fire door contains holes. Holes may be required in such doors in order to install and fit locks, and the number of holes present in such doors may become a larger problem when locks need to be replaced and additional holes need to be made.

Mortice locks are widely used. They require a pocket, the mortice, to be cut into a door, or piece of furniture, into which the lock is to be fitted. Mortice locks act as a door knob and a deadbolt, and there are many different standard configurations for such locks.

Embodiments of the present invention may address all or some of the above problems, and in particular may provide an improved access control device.

Embodiments of the present invention may provide an access control device that can be fitted or refitted to doors without needing to drill additional holes in the door for cabling or wires.

Embodiments of the present invention may eliminate the necessity for additional holes to be made, or multiple configurations or additional parts to be added, to the access control device in order to mount to doors that may have varying international standard mortice locks already assembled into them.

Embodiments of the present invention may also provide a new way of electrically passing power and or data signals between two electrical components without passing cable or wires through a traditional specific drilled hole in the door.

SUMMARY OF THE INVENTION

Aspects of the invention are set out in the independent claims and preferred features are set out in the dependent claims.

According to a first aspect of the present invention there is provided an access control device comprising:

a locking mechanism for a moveable barrier, the moveable barrier having a first side and a second side, the locking mechanism having a locked and an unlocked state;

a first locking and/or user interface component for positioning on the first side of the moveable barrier; and a second locking and/or user interface component for positioning on the second side of the moveable barrier;

wherein the first and second locking and/or user interface components are arranged to be secured to an intermediary barrier member which has been provided with either a first set of through holes for a first alternative locking member or a second set of through holes for a second alternative locking member, the first set of through holes including at least one hole having a mutually distinct position from at least one hole included in the second set of through holes, and wherein the first and second locking and/or user interface components are both provided with fixing apertures corresponding to both the first and second sets of through holes so that the locking and/or user interface components can be secured via at least one fixing placed in at least one hole corresponding to either one of the first and second alternative locking members without requiring additional through holes in the moveable barrier.

Access control units generally comprise one or more user interfaces and one or more locking components provided at access points such as doors or other moveable barriers (a moveable barrier may comprise, but is not limited to, sliding, floating or hinged doors or gates). Generally the user interface and locking components will communicate, for example so that a locking component may control access in response to signals from a user interface, or so that the status of the locking mechanism may be displayed at a user interface. The user interface and locking components may be attached to the moveable barrier (e.g. door/gate) or they may be mounted on a wall, door surround, or other stationary structural member adjacent to the moveable barrier. The term "barrier member" is intended to cover the moveable barrier itself or a stationary or other structural member associated with the moveable barrier (e.g. a door surround or adjacent wall). Often the user interface and locking components will be positioned on opposing sides of the moveable barrier. For example it is sometimes preferred to install a locking control unit on the inside ("secure" side), of the moveable barrier to prevent vandalism, to allow easier access for maintenance and/or to improve ease of communication between the locking component and a central access control server. However, it is usually necessary to place a user interface on the outside ("non-secure" side) of the moveable barrier where users can present access credentials to open the moveable barrier. One reliable means of fixing the locking and interface components at the access point is by using a fixing member passing through a barrier member and coupled to each component.

The access control device is an improvement on existing products. The access control device may be more suitable and compatible for use with a greater number of standard locking configurations. This may help reduce the need to drill additional through holes in the moveable barrier when fitting or re-fitting a new lock. Where this applies to doors, it is further desirable to reduce the number of holes or openings made at the access point because in certain jurisdictions the fire rating depends on the number of holes made through a door (the more holes, the lower the fire rating). The access control device of the present invention may therefore prevent weakening the door's fire protection rating, allowing the fire rating to stay intact without negative impact.

Advantageously, reduction in the number of holes or openings in the moveable barrier or other barrier member may not only improve the resistance to fire, but also reduce the complexity of installation of the access control device (including making locks more easily backwards-compatible) and/or increase lock durability. The access control device of the present invention may therefore provide a number of advantages over existing products.

The intermediary barrier member may be provided with either a first set of through holes for a first alternative locking member or a second set of through holes for a second alternative locking member or a third, or further, set of through holes for a third of further alternative locking member, the first, second and third, and further, set of through holes each including at least one through hole having a mutually distinct position from at least one through hole in another set of through holes, and wherein the first and second locking and/or user interface components are both provided with fixing apertures corresponding to all of the first, second and third and further sets of through holes so that the locking and/or user interface components can be secured via at least one fixing placed in one or more holes corresponding to any one of the first, second or third or further alternative locking members without requiring additional through holes in the moveable barrier.

This may make the access control device suitable and compatible with an even greater number of standard locking configurations. This may help to further reduce the need to drill additional through holes in the moveable barrier when fitting or re-fitting a new lock. Where this applies to doors, this may therefore further prevent weakening the door's fire protection rating, allowing the fire rating to stay intact without negative impact. This may not only improve the resistance to fire, but also reduce the complexity of installation of the access control device (including making locks more easily backwards-compatible) and/or increase lock durability.

The locking and/or user interface components may be secured via a plurality of fixings placed in holes corresponding to any one of the locking members. Plural fixings may make the fitting more robust and secure and may help prevent vandalism.

The intermediary barrier member may have been drilled to provide the through holes. This may provide an easy and convenient way of providing the intermediary barrier with through holes.

In use, the through holes in the intermediary barrier member and the fixing apertures in the first and second locking and/or user interface components may be closely aligned. Where the access control device is fitted to a door, generally the door has a handle, which may have a spindle for passing between first and second locking and/or user interface components, and so alignment of the holes may mean that such a spindle can be easily connected to both locking and/or user interface components.

Each set of through holes corresponds to one or more international standard mortice lock configurations. This may allow the access control device to be installed with standard mortice sash mortice lock standards without changing of mechanical parts. Such an access control device may provide a universal lockset to assemble at least some mortice lockset standards to allow simple and timely assembly to the door. This may help avoid the need to replace the existing mortice, and avoid making any further holes in the door. Replacement of such an access control device may help prevent impinging on the fire rating of the door.

Each set of through holes may correspond to one of: an EN standard mortice lockset; a Scandinavian SFS5208 standard mortice lockset; and an American ANSI A156.2 standard mortice lockset. This may allow the access control device to be installed with European, Scandinavian and American standard mortice sash mortice lock standards without changing of mechanical parts. Such an access control device may provide a universal lockset to assemble to the three aforementioned mortice lockset standards to allow simple and timely assembly to the door. This may help avoid the need to replace the existing mortice, and avoid making any further holes in the door. Replacement of the lock may help prevent impinging on the fire rating of the door.

The access control device may further comprise a fixing member for extending through a set of through holes in the intermediary barrier member and into the fixing apertures in the first and second locking and/or user interface components for securing the first and second locking and/or user interface components to the moveable barrier. One reliable means of fixing the locking and interface components at the access point is by using a fixing member passing through an intermediary barrier member and coupled to each component. A fixing/data transfer member can pass through the cooperating through holes and fixing apertures for fixing the first and second locking and/or user interface components to the intermediary barrier member, for connecting the access control device to a door for example.

The fixing member may be configured to transfer power and/or data signals between the first and second locking and/or user interface components. It is usually necessary to place a user interface on the outside ("non-secure" side) of the moveable barrier where users can present access credentials to open the moveable barrier. One reliable means of fixing the locking and interface components at the access point is by using a fixing member passing through an intermediary barrier member and moveable barrier, and coupled to each component. By providing a fixing member through which data signals can be transmitted, additional holes or openings for data transmission need not be made in the moveable barrier. Advantageously, reduction in the number of holes or openings in the moveable barrier may improve the resistance to fire, reduce the complexity of installation of the access control device (including making locks more easily backwards-compatible) and/or increase lock durability.

The fixing member may be electrically conductive. By providing a fixing member which is electrically conductive it is possible to send electrical data signals between the user interface and actuating control units. Electrical signals are an efficient means of data transfer.

The fixing member may be elongate. The fixing member may be linear. This may allow for the first and second locking and/or user interface components to be at cooperating positions on either side of the intermediary barrier member and may allow for more secure and/or simple fixing thereto. The fixing member may have any other suitable configuration.

The fixing member may be a hollow tube and may be operable to conduct power and/or data through the intermediary barrier member via one or more wires extending through the tube.

When the non-fixing member is a rigid hollow tube, it is possible to pass wires through the intermediary barrier member which may transmit data signals and/or power. Passing data and/or power through a hollow non-fixing member such as a spindle, or along grooves in the spindle may alleviate problems associated with the mechanical fasteners which can degrade over time, particularly in humid climates. Where power is to be transferred, two wires (or a multicore cable) may be preferred in order to complete the electrical circuit. Alternatively, one wire for a first electrical power connection may pass through the rigid non-fixing member and a second electrical connection may take an alternative route through the intermediary barrier member (i.e. structural/door/moving member) e.g. through a fixing member for fixing the access control device to the intermediary barrier member. Where data is to be transferred, multiple wires or only a single wire may be used. It may also be possible to transfer both data and power with a single signal over a single interface (e.g. using 1-Wire® technology).

The fixing member may comprise a multi-core cable. By providing a multi-core cable within the fixing member it is possible to transfer data flexibly. For example, there may be separate cores for data in each direction. Alternatively, or in addition, it may be possible to transfer both data signals and power supply via the same fixing member, reducing the number of holes or openings that must be made in the moveable barrier.

The fixing member may be solid. This may allow for easier installment, more secure fixing and/or may help with conducting data and/or power by electrical currents.

The fixing member may be selected from the group comprising: screws; bolts; nails; locating pins; and electrically conductive glue. There are several possible types of fixing member, each of which may provide advantages. Use of other suitable fixing members is also envisaged.

The access control device may further comprise a further fixing member for extending through a set of through holes in the intermediary barrier member and into the fixing apertures in the first and second locking and/or user interface components for securing the first and second locking and/or user interface components to the moveable barrier. By providing at least one further fixing member the access control device can be more securely attached to the intermediary barrier member. This may be particularly advantageous when a handle is provided and a user may put a turning force, or torque, on the access control device and a further fixing member may prevent the device rotating about the first fixing member. It may be important to ensure access control devices and locking mechanisms can withstand a certain amount of torque for safety and security reasons. For example, the fixing members may be operable to withstand 50 Nm torque, or preferably 60 Nm torque.

The fixing member may comprise a securing member for providing a clamping force for securing first and second locking and/or user interface components to an intermediary barrier member. This may help provide a more secure connection between the first and second locking and/or user interface components, for fixing to each other and the intermediary barrier member and/or for passing data signals and/or power therebetween. Nuts fastened onto mounting bolts may provide an adequate clamping force.

The access control device may further comprise a first handle for positioning on the first side of the moveable barrier, wherein the fixing member is a spindle for passing through the intermediary barrier member and for coupling to the first handle. By providing the rigid non-fixing member in the form of a spindle, or handle shaft, which can transmit data and/or power, it may be possible to reduce the number of holes or openings that need to be made in the moveable barrier and intermediary barrier member (e.g. door). Advantageously, this may improve the fire rating of a moveable barrier, reduce the complexity of installation of the access control device (including making locks more easily backwards-compatible) and/or increase lock durability.

The access control device may further comprise a second handle for positioning on the second side of the moveable barrier, wherein the spindle is operable to be coupled to the second handle. By providing a second handle on the second side of the moveable barrier (e.g. door or gate or wall adjacent to door) which is also coupled to the spindle, it is possible to provide access from both sides of the access point. In one example, the second handle may always be operable to allow access (e.g. by allowing retraction of a bolt locking a door). In another example, the second handle may only allow access when a user input has been accepted on the second side of the access point. This may be input via a second user interface unit. For example, this may be pressing an "exit" button, or providing a user credential that needs to be verified, such as an access code, biometric identifier or smart card.

The first locking and/or user interface component may be configured to communicate using radio frequency. The first locking and/or user interface component may include a circuit board operatively associated to a Radio Frequency Interface (RFI) badge reader for receiving a user input from a Radio Frequency (RF) access device. Using RF and RFI badge readers can be a very efficient and secure method of exchanging a user credential and/or gaining access.

The first locking and/or user interface component may be operable to receive a user credential. This may provide for a more secure lock and/or increase lock durability.

The user credential may comprise one or more of: an identifier stored on an access card or fob; a biometric identifier; and an access code.

The first locking and/or user interface component may comprise at least one of: a magnetic card, an integrated circuit (IC) card, an RFI badge or a smart card reader; a fob reader; a biometric reader; and a keypad. The credential and reader may take different forms, each of which may be particularly suited or beneficial to different applications.

The intermediary barrier member may be a mortice of a mortice lock. This may allow the access control device to be installed with standard mortice sash mortice lock standards without changing of mechanical parts. This may provide a universal lockset to assemble at lest some mortice lockset standards to allow simple and timely assembly to the door. This may help avoid the need to replace the existing mortice, and avoid making any further holes in the door. Replacement of the lock may help prevent impinging on the fire rating of the door.

The moveable barrier may be a door. In certain jurisdictions the fire rating depends on the number of holes made through a door (the more holes, the lower the fire rating) and so this may prevent weakening the door's fire protection rating, allowing the fire rating to stay intact without negative impact. Advantageously, reduction in the number of holes or openings in the door may not only improve the resistance to fire, but also reduce the complexity of installation of the access control device (including making locks more easily backwards-compatible) and/or increase lock durability.

There may be an intermediary barrier member provided for use with the access control device of the first aspect of the present invention, the intermediary barrier member may have any or all of the features described herein. There may be provided an access control system comprising the access control device of the first aspect of the present invention, and an intermediary barrier member which may have any or all of the features described herein. These may provide similar advantages to the access control device of a first aspect of the invention.

There may be provided a method of fitting an access control device of the first aspect of the present invention to a moveable barrier, the method comprising:

positioning the first locking and/or user interface component on the first side of the moveable barrier;

positioning the second locking and/or user interface component on the second side of the moveable barrier;

aligning the fixing apertures of the first and second locking and/or user interface components with a set of through holes in the intermediary barrier member, the intermediary barrier member positioned within the moveable barrier; and positioning at least one fixing member through the aligned fixing apertures and through holes to secure the first and second locking and/or user interface components and intermediary barrier member to the moveable barrier without requiring additional through holes in the moveable barrier.

This method may provide similar advantages to the access control device of the first aspect of the present invention.

The fixing member may be configured to transfer power and/or data signals between the first and second locking and/or user interface components. It is usually necessary to place a user interface on the outside ("non-secure" side) of the moveable barrier where users can present access credentials to open the moveable barrier. One reliable means of fixing the locking and interface components at the access point is by using a fixing member passing through an intermediary barrier member, and moveable barrier, and coupled to each component. By providing a fixing member through which data signals can be transmitted, additional holes or openings for data transmission need not be made in the intermediary barrier member or moveable barrier. Advantageously, reduction in the number of holes or openings in the moveable barrier or may improve the resistance to fire, reduce the complexity of installation of the access control device (including making locks more easily backwards-compatible) and/or increase lock durability.

The fixing member may be electrically conductive. By providing a fixing member which is electrically conductive it is possible to send electrical data signals between the user interface and actuating control units. Electrical signals are an efficient means of data transfer.

The fixing member may be a hollow tube and may be operable to conduct power and/or data through the intermediary barrier member via one or more wires extending through the tube, and the method may include feeding one or more wires through the hollow tube to be able to conduct power and/or data through the intermediary barrier member. When the non-fixing member is a rigid hollow tube, it is possible to pass wires through the intermediary barrier member which may transmit data signals and/or power.

Passing data and/or power through a hollow non-fixing member such as a spindle, or along grooves in the spindle may alleviate problems associated with the mechanical fasteners which can degrade over time, particularly in humid climates. Where power is to be transferred, two wires (or a multicore cable) may be preferred in order to complete the electrical circuit. Alternatively, one wire for a first electrical power connection may pass through the rigid non-fixing member and a second electrical connection may take an alternative route through the intermediary barrier member or moveable barrier (i.e. structural/door/moving member) e.g. through a fixing member for fixing the access control device to the moveable barrier. Where data is to be transferred, multiple wires or only a single wire may be used. It may also be possible to transfer both data and power with a single signal over a single interface (e.g. using 1-Wire® technology).

In another aspect of the present invention, there is provided a method of fitting an access control device to a moveable barrier, the moveable barrier having a first side and a second side, the access control device comprising: a locking mechanism for the moveable barrier, the locking mechanism having a locked and an unlocked state; a first locking and/or user interface component; and a second locking and/or user interface component; the method comprising:

positioning the first locking and/or user interface component on the first side of the moveable barrier;

positioning the second locking and/or user interface component on the second side of the moveable barrier;

aligning the fixing apertures of the first and second locking and/or user interface components with a set of through holes in the intermediary barrier member, the intermediary barrier member positioned within the moveable barrier; and positioning at least one fixing member through the aligned fixing apertures and through holes to secure the first and second locking and/or user interface components and intermediary barrier member to the moveable barrier without requiring additional through holes in the moveable barrier.

This method may provide similar advantages to the access control device of the first aspect of the present invention. This method may comprise any or all of the features of the first aspect of the present invention, as appropriate and applicable.

The fixing member may be configured to transfer power and/or data signals between the first and second locking and/or user interface components. It is usually necessary to place a user interface on the outside ("non-secure" side) of the moveable barrier where users can present access credentials to open the moveable barrier. One reliable means of fixing the locking and interface components at the access point is by using a fixing member passing through an intermediary barrier member, and moveable barrier, and coupled to each component. By providing a fixing member through which data signals can be transmitted, additional holes or openings for data transmission need not be made in the intermediary barrier member or moveable barrier. Advantageously, reduction in the number of holes or openings in the moveable barrier or may improve the resistance to fire, reduce the complexity of installation of the access control device (including making locks more easily backwards-compatible) and/or increase lock durability.

The fixing member may be electrically conductive. By providing a fixing member which is electrically conductive it is possible to send electrical data signals between the user interface and actuating control units. Electrical signals are an efficient means of data transfer.

The fixing member may be a hollow tube and may be operable to conduct power and/or data through the intermediary barrier member via one or more wires extending through the tube, and the method may include feeding one or more wires through the hollow tube to be able to conduct power and/or data through the intermediary barrier member. When the non-fixing member is a rigid hollow tube, it is possible to pass wires through the intermediary barrier member which may transmit data signals and/or power. Passing data and/or power through a hollow non-fixing member such as a spindle, or along grooves in the spindle may alleviate problems associated with the mechanical fasteners which can degrade over time, particularly in humid climates. Where power is to be transferred, two wires (or a multicore cable) may be preferred in order to complete the electrical circuit. Alternatively, one wire for a first electrical power connection may pass through the rigid non-fixing member and a second electrical connection may take an alternative route through the intermediary barrier member or moveable barrier (i.e. structural/door/moving member) e.g. through a fixing member for fixing the access control device to the moveable barrier. Where data is to be transferred, multiple wires or only a single wire may be used. It may also be possible to transfer both data and power with a single signal over a single interface (e.g. using 1-Wire® technology).

BRIEF DESCRIPTION OF THE DRAWINGS

In the following, the terms upper, lower, top, bottom, front and back/rear are used to refer to the apparatus in the orientation as shown in the accompanying drawings, which is the orientation in which the apparatus is intended to be used. These terms should not be taken as otherwise limiting.

Embodiments of the present invention will now be described, by way of example only, with reference to the accompanying drawings, of which

DESCRIPTION OF THE EMBODIMENTS

In embodiments, one component (or unit) of an access control device is required to be mechanically clamped (or secured) to each side of a door at an access point. Generally a user interface unit is positioned on one side of the door for receiving user inputs and an actuating control unit for controlling access (i.e. by locking or unlocking the door) is placed on the other side of the door. The access control device requires power and signals to be passed from one side of the door to the other to maintain functionality of the two halves of the device. Mounting holes drilled into the door potentially weaken the door's fire protection rating. Removing the need for further holes to be drilled into a door for the passing of cables, may allow the fire rating to stay intact without negative impact.

Mounting hole positions and sizes of these holes change between different international standards of mortice lockset. Any access device control that is to be clamped on both sides of the door that will mechanically utilise this mortice lock will ideally need to pass its mounting fasteners through designated holes provided on the mortice locks.

Embodiments of the present invention aim to allow the electronic access control device to be installed with at least European, Scandinavian and American standard mortice sash mortice lock standards without changing of mechanical parts.

Embodiments of the present invention aim to provide a universal lockset to assemble to at least the three aforementioned mortice lockset standards to allow simple and timely assembly to the door.

Embodiments of the present invention also aim to not impinge or reduce the fire rating of a door by drilling additional holes through it, other than holes authorised for mounting to the mortice lock, as the mortice lock by design holds its own fire rating.

The term 'door' is herein intended to mean any surface upon which an access control device can be mounted. A moveable barrier could relate to a door or other moving member, for example, a gate. The access control device may also be clamped or secured to a barrier member at an access point (e.g. a wall adjacent to an access point or door). Again, a user interface unit and an actuating control unit would normally be placed on opposite sides of the barrier member.

Figure 1:
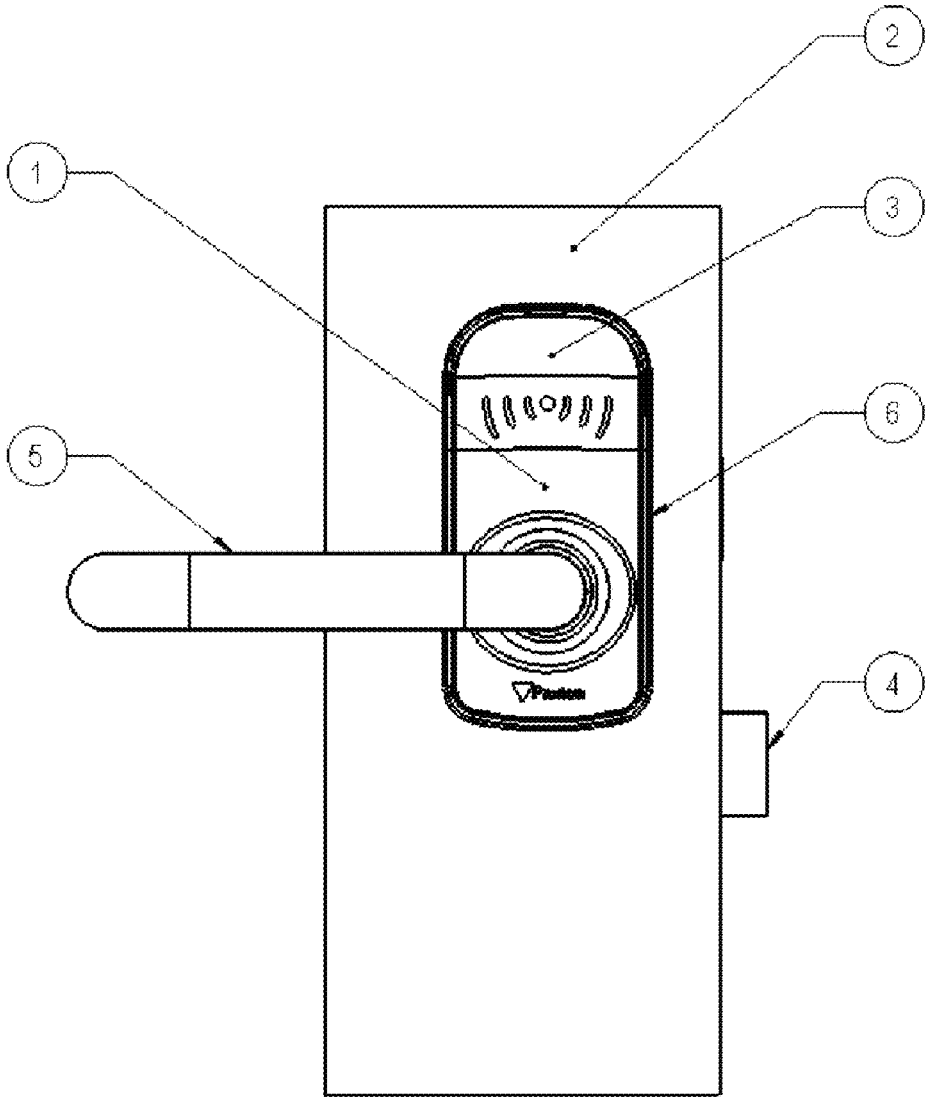
FIG. 1 is a front elevation view of a lock mounted to a door and including an electronic access control device in accordance with an embodiment of the present invention.

Referring now to the figures, FIG. 1 shows a lock 1 mounted to a door 2 for selectively preventing and enabling opening of the door 2. The lock 1 comprises an electronic access control device 3 adapted to control the operation of a mortice lock 4.

Figure 2:
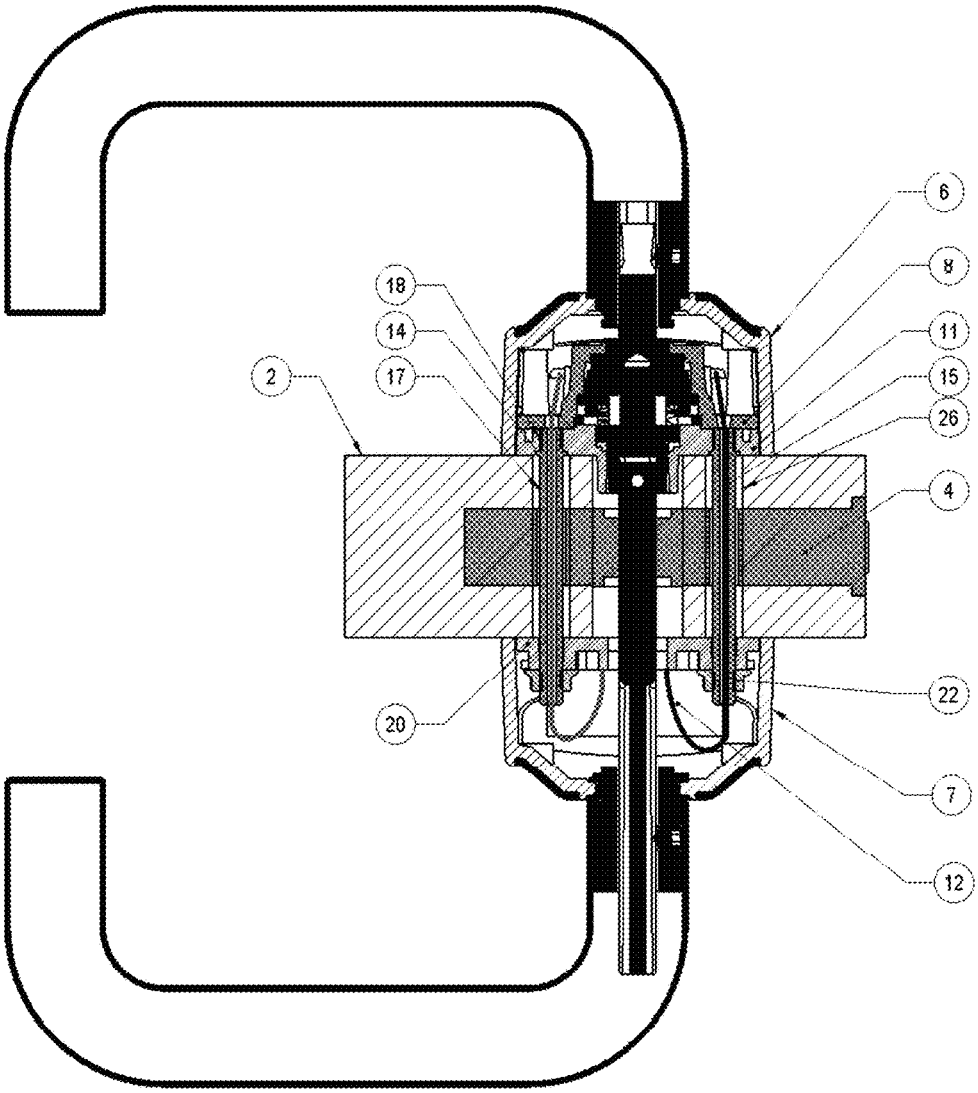
FIG. 2 is a bottom cross-sectional view of the lock shown in FIG. 1.
Figure 3:
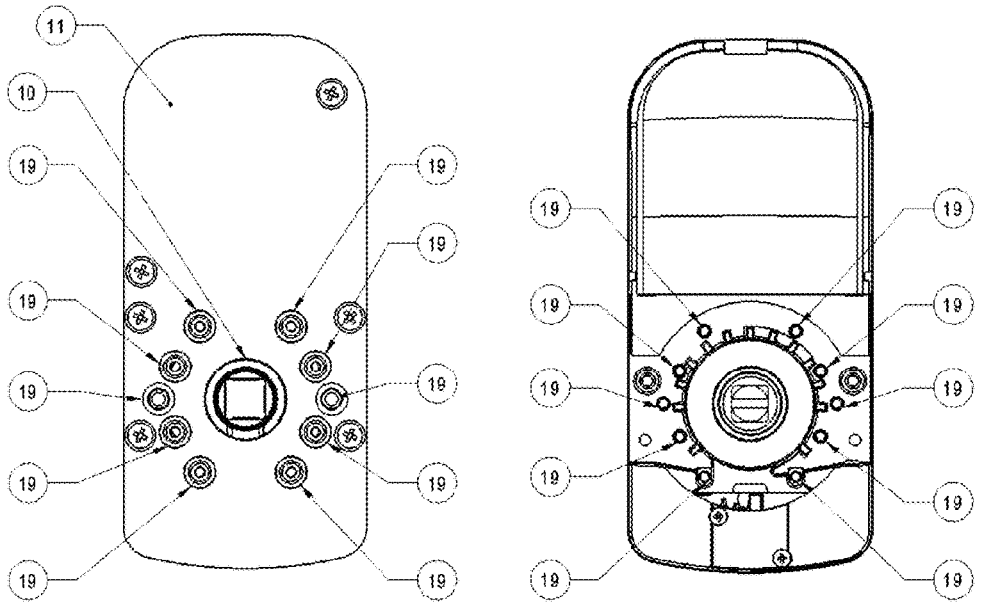
FIG. 3 is a rear and front elevation view of the lock displaying mounting hole positions.

As shown in FIGS. 2 and 3, the access control device 3 has an outdoor housing component 6 and an indoor housing component 7 adapted to be respectively mounted on the outer and inner side of the door 2 using pre-drilled holes 26. The outdoor housing component 6 houses an electronic control unit 9 (FIG. 2) operational for allowing or preventing retraction of mortice lock 4 by manual operation of a handle 5 (FIG. 1). The electronic control unit 9 typically includes a circuit board operatively associated to a RFI badge reader 3 (FIG. 1) for activation and initialisation data.

As shown in FIG. 3, the outdoor housing 6 has a front wall with a circular opening 10 for receiving the drive shaft which is connected to the handle 5 for allowing operation of the mortice lock 4. A back plate 11 is provided for closing the back face of the outdoor housing component 6 while allowing the same to be mounted to the outside surface of the door 2. The back plate 11 is preferably removably secured to the outdoor housing component 6 by means of mechanical fasteners, such as screws (not shown).

Figure 4:
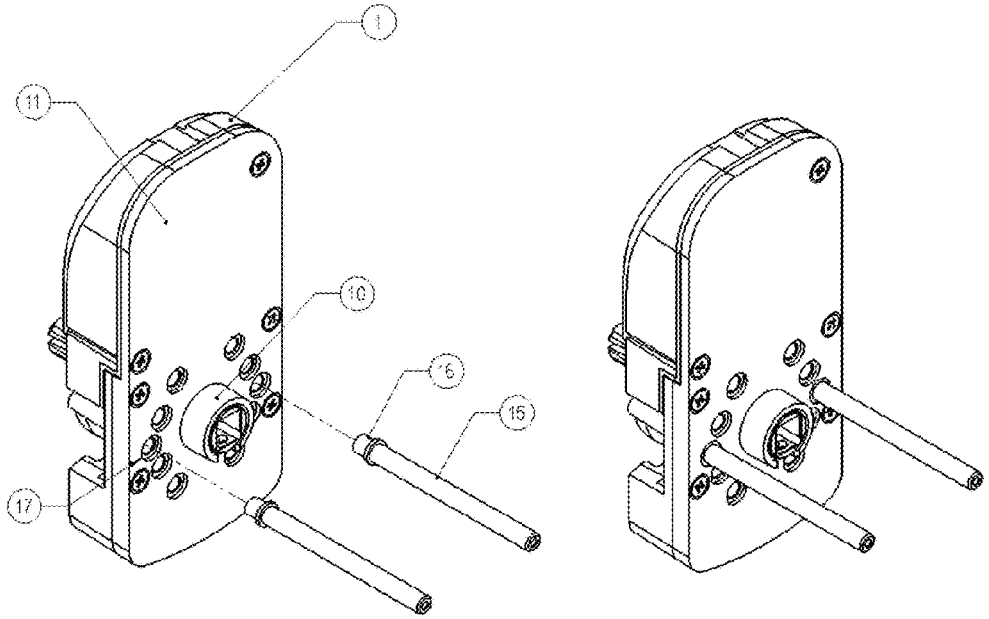
FIG. 4 is an isometric view of the lock displaying assembly of the mounting fasteners.
Figure 5:
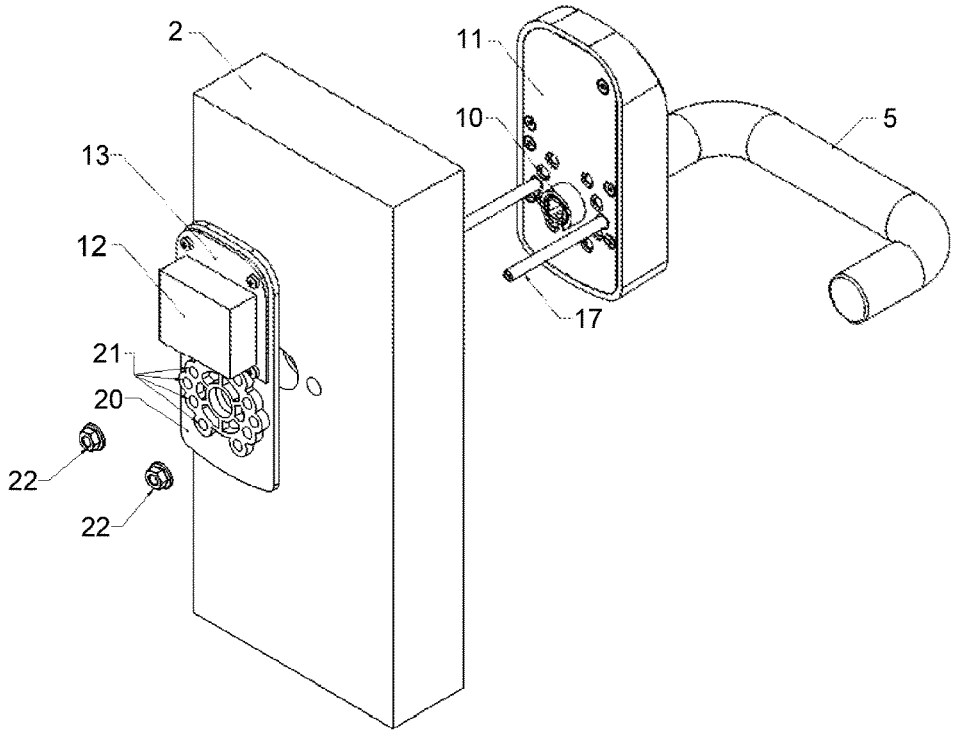
FIG. 5 is an exploded isometric view of the lock displaying the mounting of the indoor and outdoor housings to a door.
Figure 6:
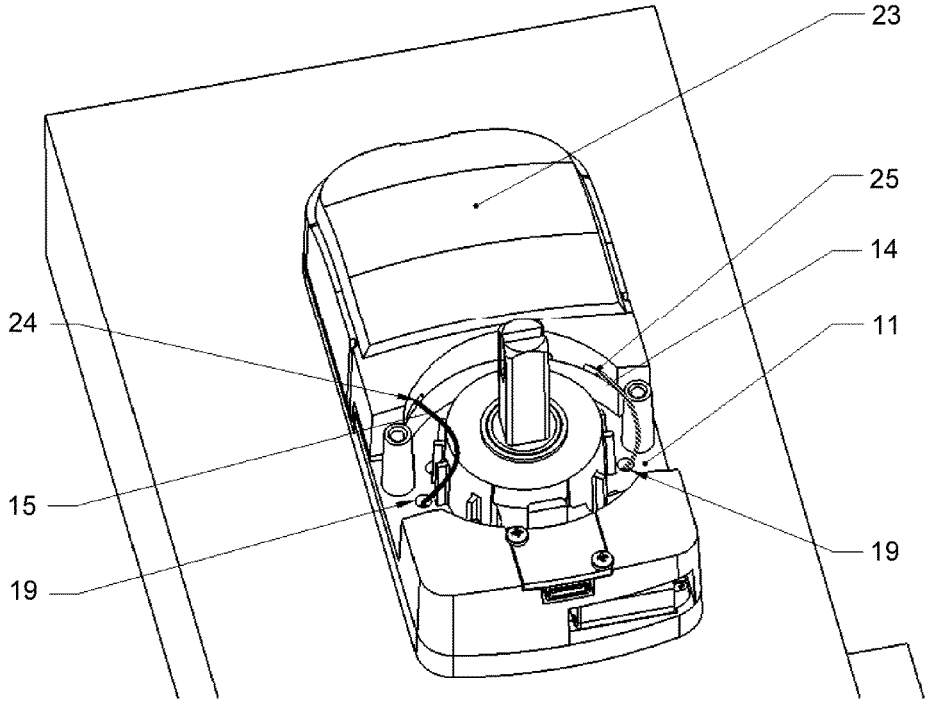
FIG. 6 is an isometric view of the outdoor housing displaying the electrical wiring passing through the mounting holes and through the mounting fasteners.
Figure 7:
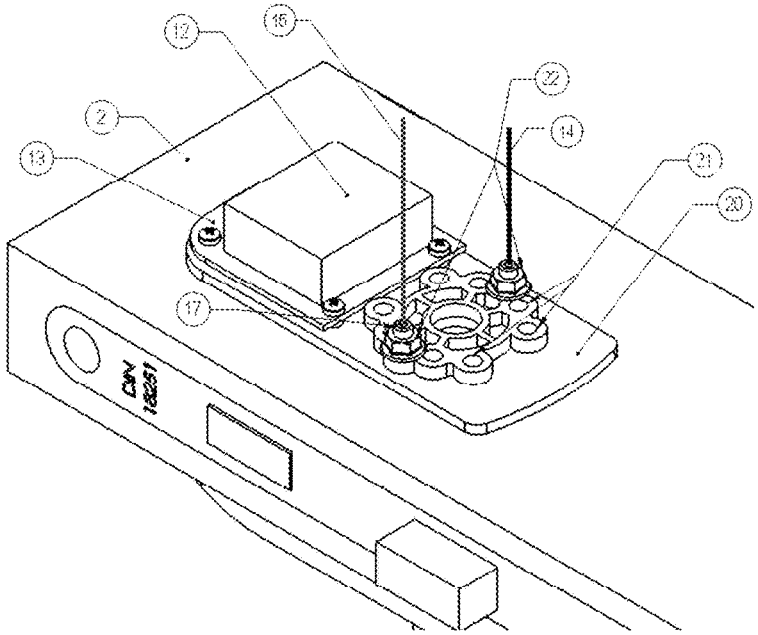
FIG. 7 is an isometric view of the indoor housing displaying the passing of the electrical wiring through the door via the mounting fasteners.

Referring to FIGS. 3 and 4, the back plate 11 of the outdoor housing component 6 comprises several sets of fixing apertures, or mounting holes, 19 which correspond to different standard mortice lock configurations, for example European, Scandinavian (left-hand LH and right-hand RH) and American (LH and RH) compliant (see also FIGS. 10, 12, 13, 15 and 16 showing some of the different standard configurations). With reference to FIG. 5, corresponding sets of fixing apertures, or mounting holes, 21 are defined by the back plate 13 of the indoor housing component 7. The mortice lock 4 fitted into the door 2 will also have a set of predefined holes, through holes, according to the standard for which the mortice is configured. Therefore, outdoor housing component 6 and indoor housing component 7 can be secured to each other, and the mortice 4 and door 2, via fixings, or mounting bolts, 17 placed in corresponding holes in all components, without requiring additional through holes to be made in the door 2, or in any other part.

A source of power is provided for powering the electronic control unit. The source of power can, for instance, be provided in the form of battery (not shown) (FIG. 4) housed in a casing 11. A source of power is provided for powering the electronic control unit. In some embodiments, electronic data signals are transmitted from the electrical control unit 13 to the electronic control unit 12 through the thickness of the door 2 via a wire 14 and or 15 that is fed through a hole in a mechanical fastener 16 that clamps both outdoor components 6 and 7 to the door 2.

As shown in FIG. 3 the installer of the lock 1 to the door 2 would select an appropriate sash mortice lockset (not shown) for installation to the door 2 and then from this fasten two mounting bolts 17 axially using a helical thread located at the base of the bolt 18 into the correct threaded mounting holes 19 the outdoor housing backplate 11. In use on a door 2, the indoor and outdoor housing components 6, 7 are placed and bolted at substantially the same height on the door as the mortice 4, and substantially linear bolts are used.

As shown in FIG. 4, 5, 6, 7 the indoor housing backplate 20 is aligned with the correct mounting holes 21 on the door 2 and mortice lock 4 allowing the passage of the mounting bolts 17 through the correct corresponding array of mounting holes 21 on the indoor mounting backplate 20. As shown in FIGS. 3, 4, 5, 6 and 7 two shouldered fixing nuts 22 are axially fastened onto the mounting bolts 17 with matching helical thread pattern until both outdoor housing component 6 and indoor housing component 7 are clamped to the door 2 with adequate clamping force.

In some embodiments, electronic data signals are generated from the electronic control units 9 and 13 to an electrically conductive wire 14 and 15.

Figure 8:
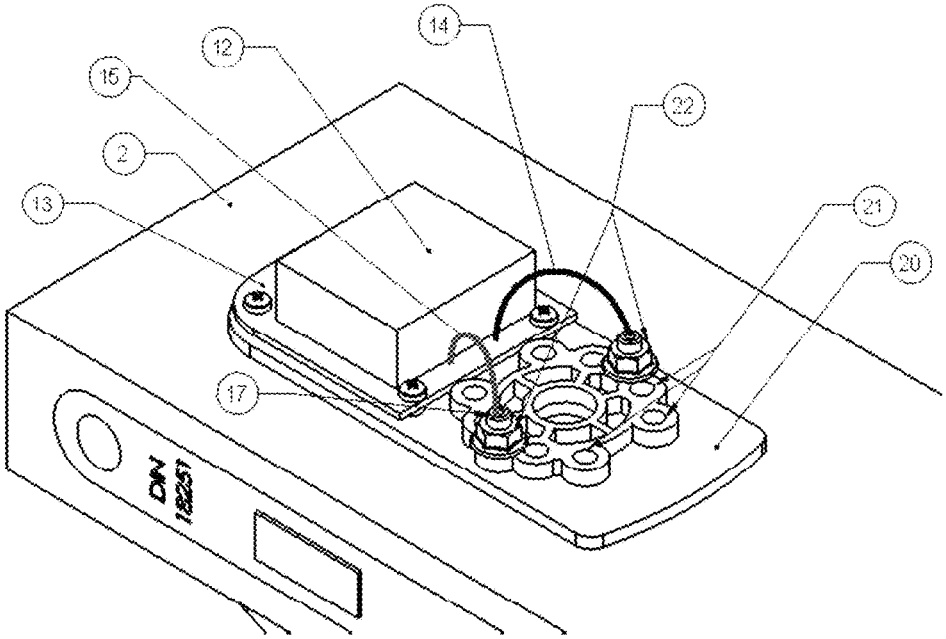
FIG. 8 is an isometric view of the indoor housing displaying the connection of the electrical wires to an electrical connection or connector on the electrical control unit.
Figure 9:
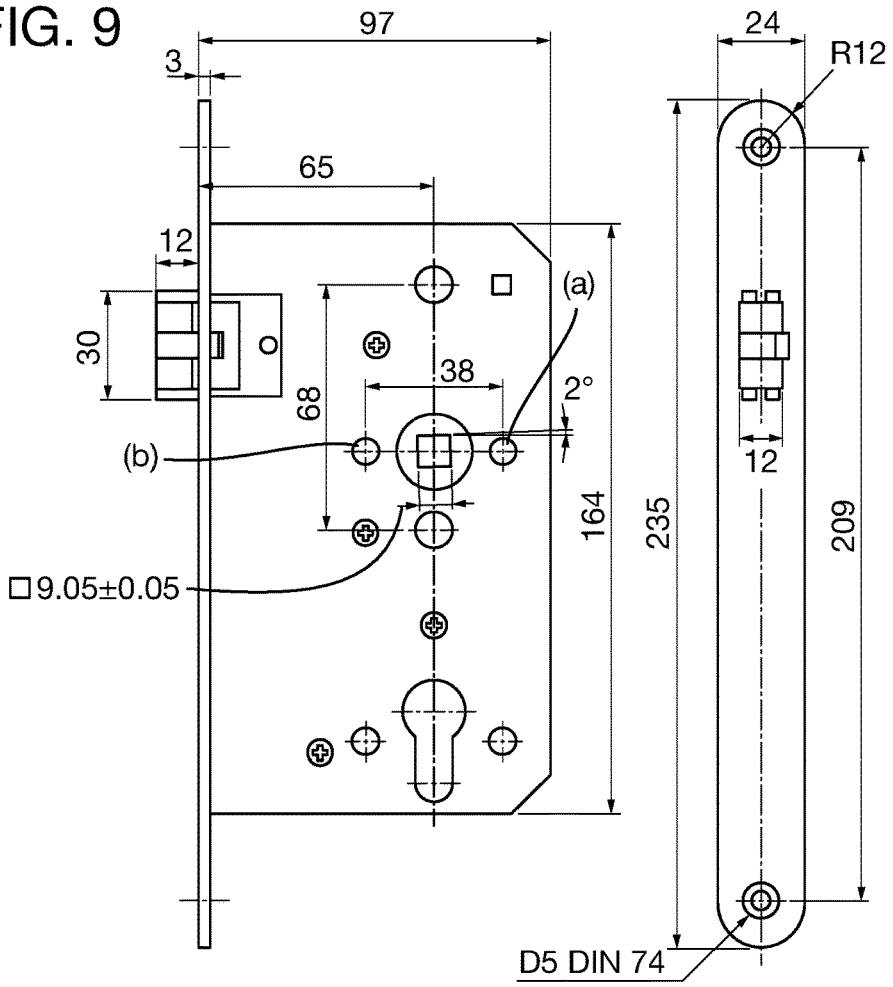
FIG. 9 is the a front and side elevation view of an EN standard mortice lockset.
Figure 10:
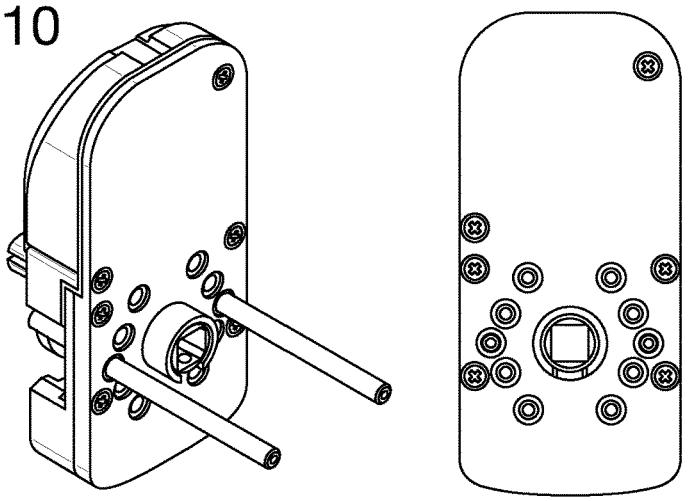
FIG. 10 is an isometric and rear elevation view of the lock configured to mounting to EN standard mortice locksets.
Figure 11:
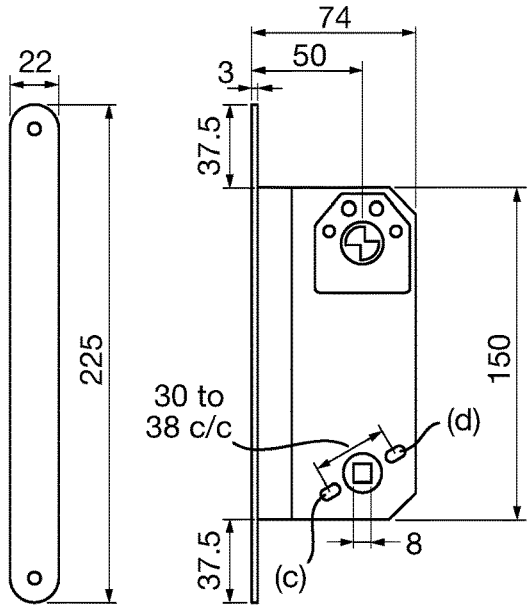
FIG. 11 is the a front and side elevation view of a Scandinavian SFS5208 standard mortice lockset.
Figure 12:
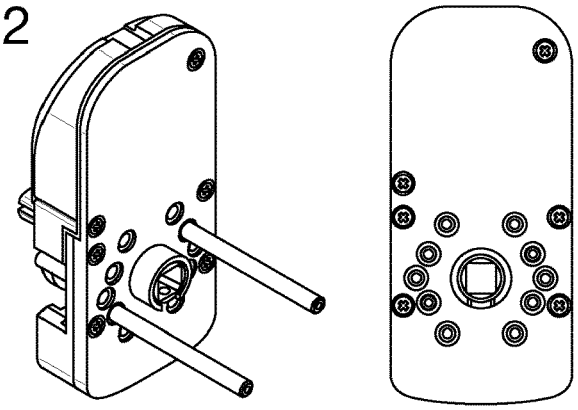
FIG. 12. is an isometric and rear elevation view of the lock configured to mounting to Scandinavian SFS5208 standard mortice locksets in left-hand (LH) orientation.
Figure 13:
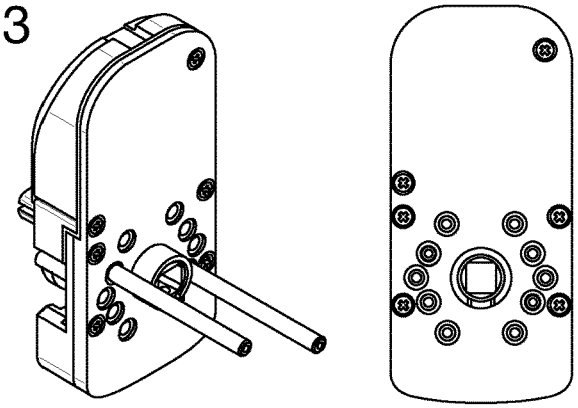
FIG. 13 is an isometric and rear elevation view of the lock configured to mounting to Scandinavian SFS5208 standard mortice locksets in right-hand (RH) orientation.
Figure 14:
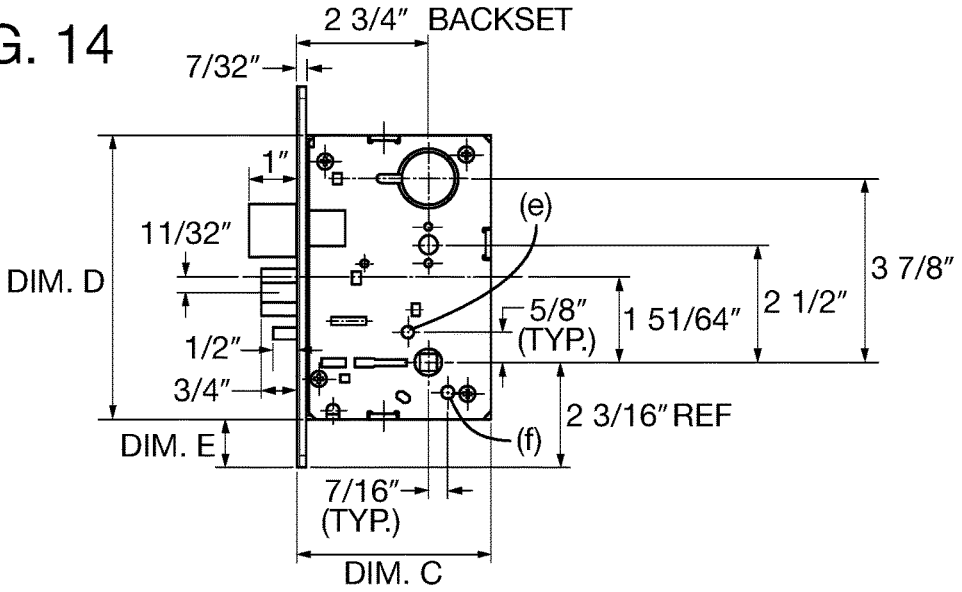
FIG. 14 is the a front and elevation view of an American ANSI A156.2 standard mortice lockset.
Figure 15:
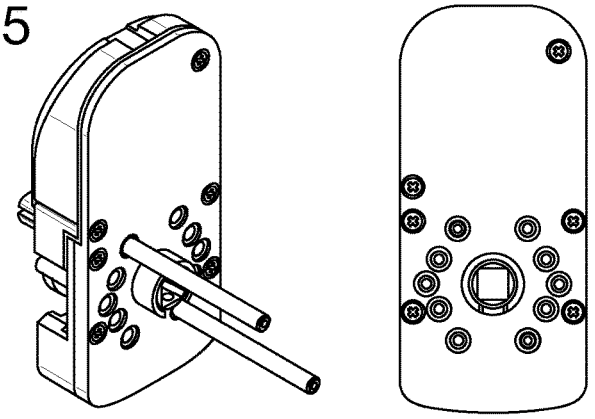
FIG. 15. is an isometric and rear elevation view of the lock configured to mounting to ANSI A156.2 standard mortice locksets in LH orientation.
Figure 16:
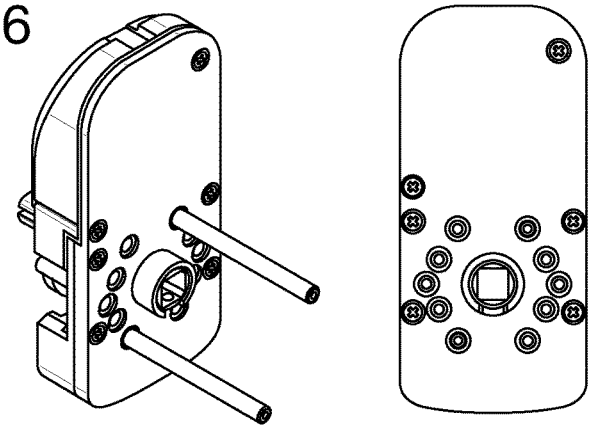
FIG. 16 is an isometric and rear elevation view of the lock configured to mounting to ANSI A156.2 standard mortice locksets in RH orientation.

As can be appreciated from FIGS. 4, 5, 6, 7 both wires 14 and 15 exit the electrical control unit 8 retained in a plastic housing 23 through two exit holes 24 and 25. Both wires 14 and 15 are fed through the appropriate mounting hole 19 on the outdoor component casting base 11, through the mounting bolt hollow channel 16 and out through to the indoor side where they emerge ready for connection into connector blocks not shown situated on the electrical control unit 13 shown in FIG. 8.

As shown in FIG. 4, if the installer wishes to reinstall the lock 1 onto another door 2 which uses a different mortice lock 4 with a different configuration of mounting holes, or through holes, the installer will unscrew the mounting bolts 17 from the outdoor mounting backplate 11 and can reposition the bolts 17 into one of the other sets of fixing apertures, or mounting holes, 19, 21, as required (and as can be seen in FIGS. 9 to 16). In this way, no new holes need to be made in the door for fitting the lock thereto and installation is simple.

In some embodiments, the bolts 17 are electrically conductive and can be used for supplying power between indoor and outdoor housing components of the lock. In some embodiments, the bolts 17 are configured to transfer data signals between indoor and outdoor housing components of the lock. In some embodiments, one or more bolts 17 can be used for transferring power, and another one or more bolts can be used for transmitting data signals. In some embodiments, the bolts 17 are hollow and contain wires therein for transferring the power and/or data signals. In some embodiments, the spindle of a door handle passes between mounting holes 19, 21 and corresponding through holes in the mortice to prevent any further holes needing to be made in the door for this purpose.

As will be appreciated, the lock 1 could be mounted on a doorframe or a wall, or any piece of furniture or other required object, and is not limited to use on a door 2. Any other features associated with such locks and known to those skilled in the art, but not explicitly stated herein, may also be present.

The above embodiments are described by way of example only. Many variations are possible without departing from the scope of the invention as defined in the appended claims.

What is claimed is:

1. An access control device comprising:

a locking mechanism for a moveable barrier, the moveable barrier having a first side and a second side, the locking mechanism having a locked and an unlocked state;

a first locking and/or user interface component for positioning on the first side of the moveable barrier; and a second locking and/or user interface component for positioning on the second side of the moveable barrier;

wherein the first and second locking and/or user interface components are arranged to be secured to an intermediary barrier member which has been provided with either a first set of through holes for a first alternative locking member or a second set of through holes for a second alternative locking member, the first set of through holes including at least one hole having a mutually distinct position from at least one hole included in the second set of through holes, and wherein the first and second locking and/or user interface components are both provided with fixing apertures corresponding to both the first and second sets of through holes so that the locking and/or user interface components can be secured via at least one fixing placed in at least one hole corresponding to either one of the first and second alternative locking members without requiring additional through holes in the intermediary barrier member; and further comprising a fixing member for extending through a set of through holes in the intermediary barrier member and into the fixing apertures in the first and second locking and/or user interface components for securing the first and second locking and/or user interface components to the intermediary barrier member;

wherein the fixing member is configured to transfer power and/or data signals between the first and second locking and/or user interface components;

wherein the fixing member is a hollow tube and is operable to conduct power and/or data through the intermediary barrier member via one or more wires extending through the tube.

2. An access control device as claimed in claim 1, wherein the first and second locking and/or user interface components are arranged for securing to an intermediary barrier member has been provided with either a first set of through holes for a first alternative locking member or a second set of through holes for a second alternative locking member or a third, or further, set of through holes for a third of further alternative locking member, the first, second and third, and further, set of through holes each including at least one through hole having a mutually distinct position from at least one through hole in another set of through holes, and wherein the first and second locking and/or user interface components are both provided with fixing apertures corresponding to all of the first, second and third and further sets of through holes so that the locking and/or user interface components can be secured via at least one fixing placed in one or more holes corresponding to any one of the first, second or third or further alternative locking members without requiring additional through holes in the moveable barrier.

3. An access control device as claimed in claim 1, wherein the locking and/or user interface components can be secured via a plurality of fixings placed in holes corresponding to any one of the locking members.

4. An access control device as claimed in claim 1, wherein, in use, the through holes in the intermediary barrier member and the fixing apertures in the first and second locking and/or user interface components are closely aligned.

5. An access control device as claimed in claim 1, wherein each set of through holes corresponds to one or more international standard mortice lock configurations.

6. An access control device as claimed in claim 1, wherein the fixing member comprises a multi-core cable.

7. An access control device as claimed in claim 1, wherein the fixing member is selected from the group comprising:

screws;

bolts;

nails; and locating pins.

8. An access control device as claimed in claim 1, comprising a further fixing member for extending through a set of through holes in the intermediary barrier member and into the fixing apertures in the first and second locking and/or user interface components for securing the first and second locking and/or user interface components to the intermediary barrier member.

9. An access control device as claimed in claim 1, wherein the fixing member comprises a securing member for providing a clamping force for securing first and second locking and/or user interface components to an intermediary barrier member.

10. An access control device as claimed in claim 1, further comprising a first handle for positioning on the first side of the moveable barrier, and a non-fixing member being a spindle for passing through the intermediary barrier member and for coupling to the first handle, and a second handle for positioning on the second side of the moveable barrier, wherein the spindle is operable to be coupled to the second handle.

11. An access control device as claimed in claim 1, wherein the first locking and/or user interface component is configured to communicate using radio frequency.

12. An access control device as claimed in claim 1, wherein the first locking and/or user interface component is operable to receive a user credential, wherein the user credential comprises one or more of:

an identifier stored on an access card or fob;

a biometric identifier; and an access code;

wherein the first locking and/or user interface component comprises at least one of:

a magnetic card, an integrated circuit (IC) card, an RFI badge or a smart card reader;

a fob reader;

a biometric reader; and a keypad.

13. A method of fitting the access control device of claim 1 to a moveable barrier, the method comprising:

positioning the first locking and/or user interface component on the first side of the moveable barrier;

positioning the second locking and/or user interface component on the second side of the moveable barrier;

aligning the fixing apertures of the first and second locking and/or user interface components with a set of through holes in the intermediary barrier member, the intermediary barrier member positioned within the moveable barrier; and positioning at least one fixing member through the aligned fixing apertures and through holes to secure the first and second locking and/or user interface components and intermediary barrier member to the moveable barrier without requiring additional through holes in the moveable barrier; wherein the fixing member is configured to transfer power and/or data signals between the first and second locking and/or user interface components; and wherein the fixing member is a hollow tube and is operable to conduct power and/or data through the intermediary barrier member via one or more wires extending through the tube, and the method includes feeding one or more wires through the hollow tube to be able to conduct power and/or data through the intermediary barrier member.

14. A method of fitting an access control device to a moveable barrier, the moveable barrier having a first side and a second side, the access control device comprising: a locking mechanism for the moveable barrier, the locking mechanism having a locked and an unlocked state; a first locking and/or user interface component; and a second locking and/or user interface component; the method comprising:

positioning the first locking and/or user interface component on the first side of the moveable barrier;

positioning the second locking and/or user interface component on the second side of the moveable barrier;

aligning the fixing apertures of the first and second locking and/or user interface components with a set of through holes in the intermediary barrier member, the intermediary barrier member positioned within the moveable barrier; and positioning at least one fixing member through the aligned fixing apertures and through holes to secure the first and second locking and/or user interface components and intermediary barrier member to the moveable barrier without requiring additional through holes in the moveable barrier; wherein the fixing member is configured to transfer power and/or data signals between the first and second locking and/or user interface components; and wherein the fixing member is a hollow tube and is operable to conduct power and/or data through the intermediary barrier member via one or more wires extending through the tube, and the method includes feeding one or more wires through the hollow tube to be able to conduct power and/or data through the intermediary barrier member.

* * * * *